United States Patent [19]

Brock

[11] Patent Number: 4,993,839

[45] Date of Patent: Feb. 19, 1991

[54] METHOD AND APPARATUS FOR PRODUCING ASPHALTIC MIX

[75] Inventor: J. Donald Brock, Chattanooga, Tenn.

[73] Assignee: Astec Industries, Inc., Chattanooga, Tenn.

[21] Appl. No.: 325,783

[22] Filed: Mar. 20, 1989

[51] Int. Cl.[5] ..... B01F 3/20

[52] U.S. Cl. ..... 366/7; 366/26; 366/27; 366/41; 366/146; 366/348

[58] Field of Search ..... 366/2, 7, 4, 16, 18, 366/27, 26, 41, 141, 146, 348

[56] References Cited

U.S. PATENT DOCUMENTS

| | | | |
|---|---|---|---|
| 1,867,739 | 7/1932 | Frazee | 366/26 |
| 2,893,602 | 7/1957 | Barber et al. | 366/18 |
| 3,091,369 | 5/1963 | Sackett, Sr. | 366/18 X |
| 3,263,971 | 8/1966 | Farnham | 366/26 X |
| 3,304,065 | 2/1967 | Eaton . | |
| 3,314,557 | 4/1967 | Sackett, Sr. | 366/18 X |
| 3,554,498 | 1/1971 | Laycock . | |
| 3,586,181 | 6/1971 | Brock . | |
| 3,661,365 | 5/1972 | Cloud, Jr. | 366/18 |
| 3,741,537 | 6/1973 | Farnham et al. | 366/141 |
| 3,809,373 | 5/1974 | Brock | 366/18 |
| 3,853,305 | 12/1974 | Mize . | |
| 4,190,370 | 2/1980 | Brock et al. . | |
| 4,248,359 | 2/1981 | Brock . | |
| 4,387,996 | 6/1983 | Mendenhall | 366/4 |

*Primary Examiner*—Frankie L. Stinson

*Attorney, Agent, or Firm*—Bell, Seltzer, Park & Gibson

[57] ABSTRACT

A method and apparatus for producing asphaltic mix for roadway use is disclosed, and which comprises a primary plant which is designed to be located remote from the point of use, and a separate satellite plant which is designed to be located relatively close to the point of use. The primary plant heats and dries the stone aggregate, segregates the aggregate by size, and mixes the aggregate with a small amount of liquid asphalt so as to suppress the dust. The resulting pre-mixed product of the primary plant is then transported by truck to the satellite plant, where it is stored and then mixed with a further quantity of liquid asphalt to render the mix suitable for roadway use. The primary plant performs the functions which require substantial equipment and space, and which have the more significant environmental impact, whereas the satellite plant may be relatively small and inexpensive, and its operation makes no significant environmental impact. As a result, the satellite plant can usually be located very near the point of use, thereby reducing transportation costs.

10 Claims, 3 Drawing Sheets

METHOD AND APPARATUS FOR PRODUCING ASPHALTIC MIX

FIELD OF THE INVENTION

The present invention relates to a method and apparatus for producing an asphaltic mix suitable for use in forming or resurfacing a roadway.

BACKGROUND OF THE INVENTION

Conventional batch type plants for producing asphaltic mix typically comprise a drum dryer for heating and drying the stone aggregate, and a vertical bucket elevator for conveying the heated and dried aggregate from the dryer to the top of a tower. The tower includes an enclosed vibrating screen section at the top, for receiving and segregating the aggregate by size. The segregated aggregate then drops through individual chutes to a bin section which underlies the screen section, and which comprises a plurality of separate bins, and so that each bin receives an aggregate of a predetermined average size from the screen section. A weigh hopper is positioned below the bins, which permits the aggregate from one or more bins to be weighed out to provide a desired mixture, as required for example for a roadway base coat or a finish coat. A mixing pugmill is positioned below the weigh hopper for mixing the weighed quantity of aggregate with hot liquid asphalt, and the bottom of the pugmill includes a gate opening, such that the contents may be dropped into an underlying truck.

It is desirable to locate the asphalt plant as near as possible to the point of use, in order to minimize trucking expense. However, it often is not possible to locate the plant as near to the point of use as would be desirable. For example, conventional plants often generate dust and contribute to air pollution, and they may be noisy. As a result, many localities will not issue the necessary permits. Also, the projected asphalt production may not justify the expense of a conventional plant, or the space may be too limited or too expensive to justify a plant.

It is accordingly an object of the present invention to provide a method and apparatus for producing asphaltic mix and which avoids or at least minimizes the above noted problems associated with conventional plants.

It is a more specific object of the present invention to provide a method and apparatus of the described type and which utilizes a satellite plant which has a low environmental impact, which is relatively small in size and cost, and which can be profitably located at sites which are impractical for conventional plants.

SUMMARY OF THE PRESENT INVENTION

The above and other objects and advantages of the present invention are achieved in the embodiment illustrated herein by the provision of a method and apparatus wherein the basic operations of the conventional asphalt plant are performed at two separate locations, namely a central primary plant and a separate satellite plant. The primary plant can be located remote from the point of use, such as adjacent the rock quarry which supplies the aggregate, while the satellite plant is designed so as to permit it to be located immediately adjacent the job site.

At the primary plant of the present invention, the stone aggregate is heated and dried, and then mixed with a relatively small quantity of liquid asphalt, and which is only sufficient to eliminate the dust which is naturally associated with the aggregate. The pre-mixed aggregate and liquid asphalt is then transported to the satellite plant, which includes at least one storage bin for receiving the pre-mixed product. When ready for use, the stored pre-mixed product is mixed with a further quantity of liquid asphalt, to form an asphaltic mix which is suitable for use in forming or resurfacing a roadway.

As will be apparent, the primary plant will perform those functions which have a more significant environmental impact, as well as those functions which take up much of the space normally required by asphalt plants. The satellite plant on the other hand performs functions which have a low environmental impact, and thus it can be of relatively small size and low cost. As a result, it is usually possible to locate the satellite plant immediately adjacent the point of use, and where it would not be practical to locate a conventional plant.

In accordance with the preferred embodiment of the present invention, the primary plant is in certain respects similar in construction to the conventional batch type plant, and it includes a drum dryer, a bucket elevator, and a tower. The drum dryer serves to heat and dry the aggregate, and the elevator is used to convey the heated and dried aggregate to the top of the tower. The tower mounts a screen section for segregating the heated and dried aggregate by particle size and delivering the sized aggregate in sized groupings of differing average particle size to separate storage bins. Aggregate of a selected size or mixture of sizes as required by a particular job, is then processed through the weigh batcher and pugmill. However, in accordance with the method of the present invention, only enough asphalt is mixed with the aggregate in the pugmill to suppress the dust which is associated with the aggregate, and this pre-mixed product is then transported to the satellite plant. Such transport may be conducted during off peak hours so as to avoid traffic congestion, and so as to increase the utilization of the equipment.

At the satellite plant, the pre-mixed product from the primary plant is elevated in an elevator and placed in an appropriate storage bin in a relatively small tower. Since the product is presegregated by size, diverter chutes can be used to direct the product directly into the appropriate bin, and no screening is required. To finish the production of the product at the satellite plant, the proper weight of the pre-mixed aggregate is weighed from each bin, and mixed in a pugmill mixer with sufficient additional liquid asphalt to make the specified mix. The resulting product is then ready to be transported by truck to the nearby construction site.

The storage bins in the tower at the primary plant, and the storage bins in the tower at the satellite plant are preferably heat insulated. Thus the heat energy added by the initial dryer, and by the heat of the liquid asphalt added at the primary plant, is substantially maintained until the finished product is ready for use. Thus the aggregate is maintained at a temperature well above ambient temperature throughout all of the steps of the present method.

BRIEF DESCRIPTION OF THE DRAWINGS

Some of the objects and advantages of the present invention having been stated, others will appear as the description proceeds, when taken in conjunction with the accompanying somewhat schematic drawings, in which.

DETAILED DESCRIPTION OF THE PREFERRED EMBODIMENT

Figure 1:
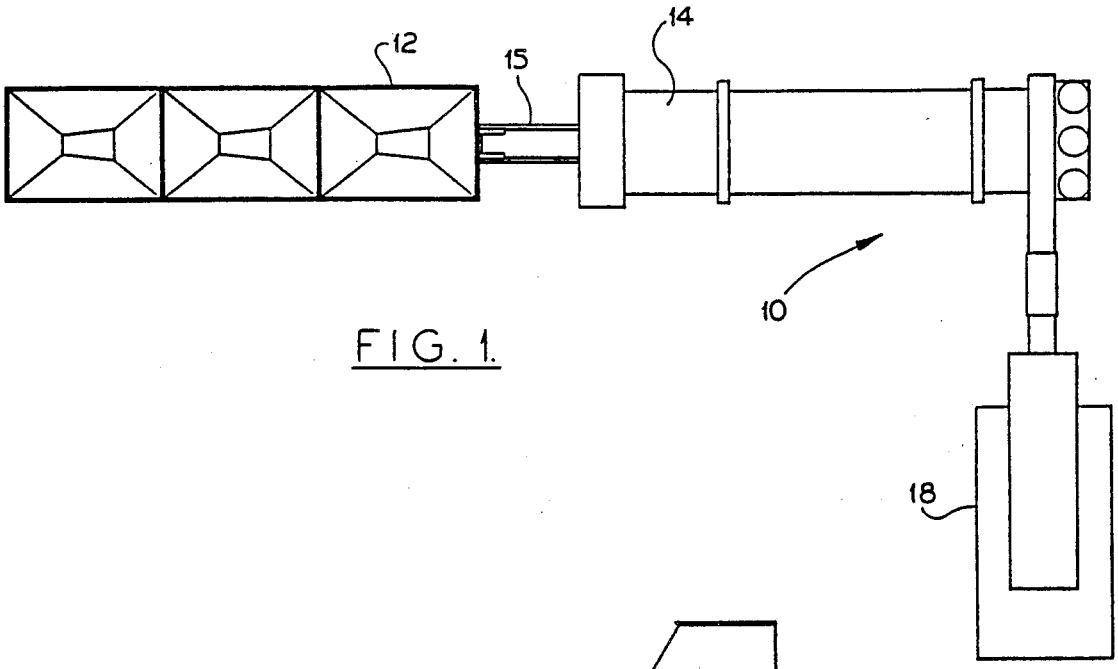
FIG. 1 is a top plan view of a primary plant in accordance with the present invention.
Figure 2:
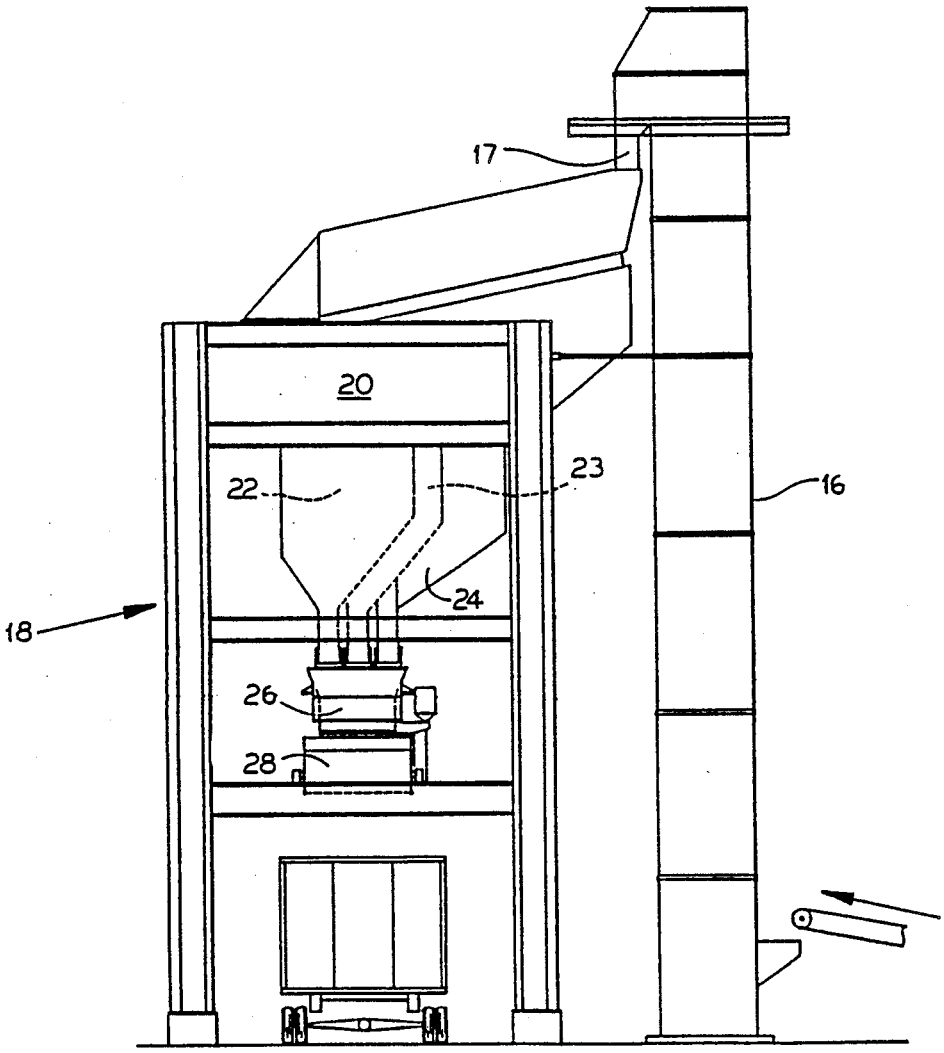
FIG. 2 is side elevation view of the primary plant.

Referring more particularly to the drawings, FIGS. 1 and 2 schematically illustrate a preferred embodiment of the primary plant of the present invention at 10. The primary plant 10 comprises a series of feed bins 12 for storing the stone aggregate, and a drum dryer 14 for heating and drying stone aggregate. An inclined conveyor 15 delivers the aggregate from selected bins to the mixer, and the dryer 14 delivers the heated and dried aggregate to a bucket type enclosed elevator 16, which conveys the aggregate upwardly to a discharge outlet 17 located above a tower 18.

A screen section 20 is mounted at the top of the tower 18 for receiving the aggregate, and the screen section 20 is adapted to segregate the aggregate by particle size so as to obtain three aggregate groupings of differing average particle size in the illustrated embodiment. Three separate and heat insulated storage bins 22, 23, 24 are located below the screen section, and suitable chutes are positioned between the screen section 20 and bins 22–24 for delivering each of the aggregate groupings to a separate one of the bins. While three aggregate groupings and bins are disclosed in the illustrated embodiment, it will be understood that a smaller or larger number may be employed.

A weigh hopper 26 is positioned below the bins 22–24 for weighing out predetermined amounts of the aggregate from each of the storage bins. The lower portion of the weigh hopper includes a discharge gate, which permits rapid discharge of its weighed contents into an underlying pugmill 28. The pugmill 28 mixes the weighed out aggregate with a weighed quantity of hot liquid asphalt which is delivered from an asphalt weigh bucket and spray system (not shown). The bottom of the pugmill includes a discharge gate through which the mixed product may be dropped directly into an underlying truck as seen in FIG. 2.

All of the above described components of the primary plant 10 are conventional, and a plant of this construction is presently sold by Astec Industries, Inc. of Chattanooga, Tennessee. Also, components of a plant of this general type are illustrated in U.S. Pat. Nos. 3,853,305; and 4,190,370.

Figure 3:
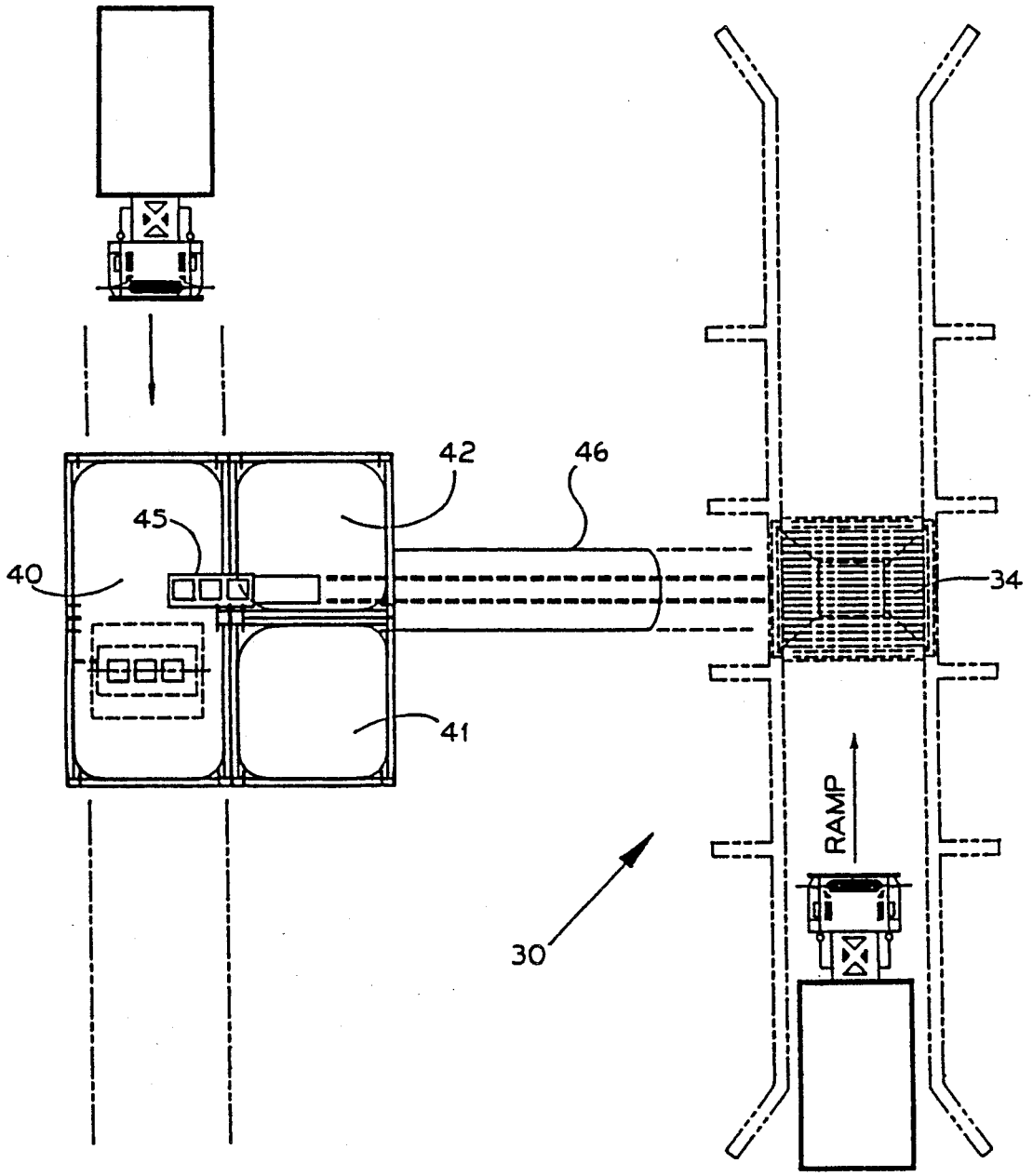
FIG. 3 is a top plan view of a satellite plant in accordance with the present invention.
Figure 5:
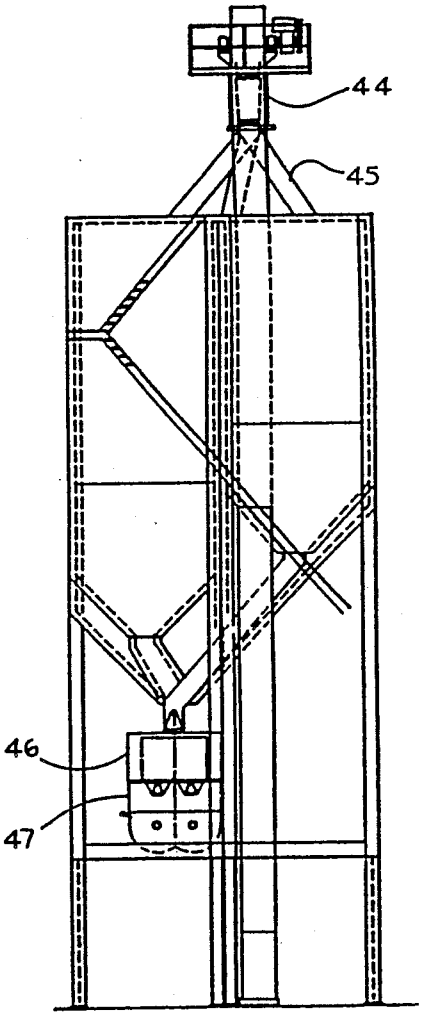
FIGS. 4 and 5 are front and side elevation views of the satellite plant respectively.
Figure 4:
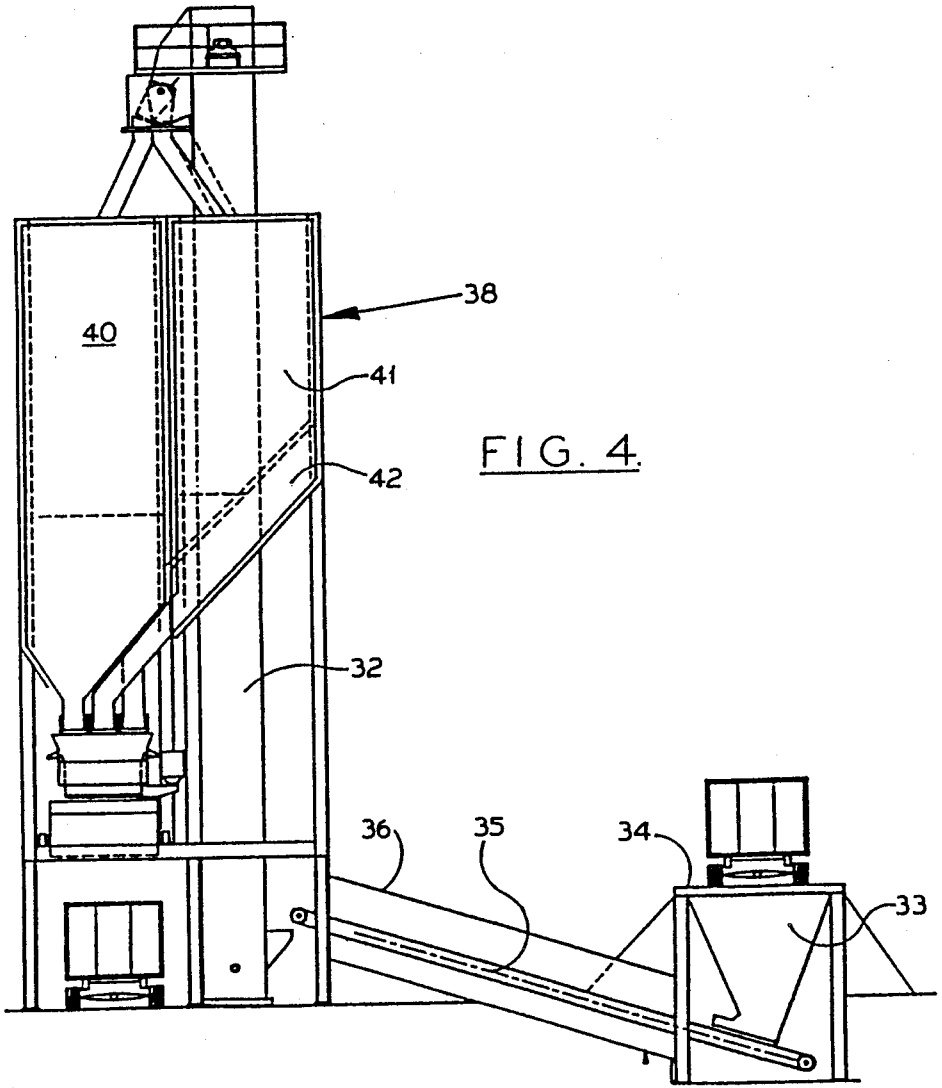

The apparatus of the present invention also includes a satellite plant 30 as illustrated in FIGS. 3–5. The satellite plant 30 includes a delivery system by which the pre-mixed product from the primary plant may be delivered to a vertical bucket type elevator 32. More particularly, the delivery system includes a funnel 33 located slightly above ground level for receiving the product from the delivery truck. Suitable ramps may be located on either side of the funnel, and the top of the funnel mounts a supporting grill 34, so as to permit the trucks to drive across the top of the funnel. The discharge of the funnel overlies a conveyor belt 35 which extends upwardly through a tubular tunnel 36, and the discharge end of the conveyor belt 35 overlies the lower entrance opening of the elevator 32.

The satellite plant 30 also includes a tower 38, which mounts three heat insulated storage bins 40, 41, 42 in the illustrated embodiment. The tower 38 is positioned immediately adjacent the elevator 32, and so that the discharge outlet 44 of the elevator is positioned above the three bins. Also, a diverter chute 45 is positioned between the outlet of the elevator and the top of the bins for directing the product into a selected one of the bins. A weigh hopper 46 and a pugmill 47 as described above are mounted in the tower below the bins. Thus a selected amount of the product from each of the bins 40–42 may be mixed with an additional quantity of hot liquid asphalt, and then delivered to an underlying truck for transport to the construction site.

In accordance with the present invention, stone aggregate is initially heated and dried in the dryer 14 at the primary plant, and the heated and dried aggregate is then segregated by particle size in the screen section 20 of the tower at the primary plant so as to obtain a plurality of aggregate groupings of differing average particle size. Each of the aggregate groupings are delivered to a separate one of the storage bins 22–24, and a predetermined amount of the aggregate from one or more of the bins may then be weighed out in accordance with the requirements of the desired final product, and as required for example for a roadway base coat or a finish coat. The weighed out aggregate is then mixed with a relatively small quantity of liquid asphalt in the pugmill 28, so as to suppress the dust. Typically, between about ¼% to 1½% hot liquid asphalt is mixed with the aggregate, by weight, to achieve this result. The resulting pre-mixed product, which retains most of the heat added by the drum dryer and the heat of the asphalt, is then delivered to a truck, and transported from the primary plant location to the satellite plant location.

At the satellite plant 30, the pre-mixed product is delivered into the funnel 33 directly from the truck, and the material is conveyed on the conveyor 35 into the entrance opening of the vertical bucket type conveyor 32. The product is then lifted and delivered to the diverter chute 44, which is set to deliver the aggregate into a desired one of the three insulated bins 40–42, with the insulated bins again serving to maintain the product in a heated condition. It will also be noted that it is not necessary to segregate the product by particle size at the satellite plant, since the size has been determined at the primary plant and is known. Also, since three bins are located at the satellite plant, three separate compositions may be concurrently stored.

When a particular mixed product is needed at the construction site, a predetermined amount is weighed out from the appropriate storage bin or bins, and delivered to the pugmill 47. A further quantity of hot liquid asphalt is then mixed with the still heated product to form an asphaltic mix suitable for use in forming or resurfacing a roadway. Typically, the further quantity of the hot liquid asphalt which is mixed with the pre-mixed product in the pugmill of the satellite plant, is such that the total asphalt content is between about 3 to 8% by weight.

In the drawings and specification, there has been set forth a preferred embodiment of the invention, and although specific terms are employed, they are used in a generic and descriptive sense only and not for purposes of limitation.

That which is claimed is:

1. A method of producing asphaltic mix suitable for use in forming or resurfacing a roadway, and comprising the steps of heating and substantially drying a quantity of stone aggregate at a primary plant location, mixing the heated and dried aggregate with a relatively small quantity of heated liquid asphalt at the primary plant location to form a pre-mixed hot product, transporting the pre-mixed hot product to a satellite plant on location, then mixing the pre-mixed product while still hot with a further quantity of hot liquid asphalt at the satellite plant location, to form a hot asphaltic mix suitable for use in forming or resurfacing a roadway.

2. The method as defined in claim 1 comprising the further step of storing the pre-mixed heated product at the satellite plant location prior to mixing the pre-mixed product with a further quantity of liquid asphalt and while maintaining the pre-mixed product in a heated condition.

3. A method of producing asphaltic mix suitable for use in forming or resurfacing a roadway, and comprising the steps of (a) heating and substantially drying stone aggregate at a primary plant location, (b) segregating the heated and dried aggregate by particle size at the primary plant location so as to obtain a plurality of aggregate groupings of differing average particle size, (c) delivering each of the aggregate groupings to a separate storage bin at the primary plant location while in heated condition, (d) weighing out a predetermined amount of the heated aggregate from one or more of said storage bins, (e) mixing the weighed out heated aggregate with a relatively small quantity of heated liquid asphalt at the primary plant location and so as to produce a hot pre-mixed product, (f) transporting the pre-mixed hot product from the primary plant location to a satellite plant location, (g) while still hot delivering the pre-mixed product into one or more separate storage bins at said satellite plant location, (h) while still hot weighing out a predetermined amount of the pre-mixed product from one or more of said storage bins at said satellite plant location, and (i) mixing the weighted out pre-mixed product with a further quantity of heated liquid asphalt to form a hot asphaltic mix suitable for use in forming or resurfacing a roadway.

4. The method as defined in claim 3 wherein step (e) includes mixing between about ½% to 1½% heated liquid asphalt with the aggregate.

5. The method as defined in claim 4 wherein step (i) includes mixing a further quantity of heated liquid asphalt with the pre-mixed product such that the total asphalt content of the resulting asphaltic mix is between about 3 to 8%.

6. The method as defined in claim 3 wherein the aggregate is maintained at a temperature above ambient temperature throughout all of the steps of the method.

7. An apparatus for producing asphaltic mix suitable for use in forming or resurfacing a roadway, and comprising a primary plant including means for heating and drying stone aggregate, a plurality of separate storage bins, means for segregating the heated and dried aggregate by particle size so as to obtain a plurality of aggregate groupings of differing average particle size and for delivering each of the groupings to a separate one of said primary storage bins, weigh hopper means for weighing out predetermined amounts of the aggregate from each of said storage bins, and mixing means for mixing the weighed out heated aggregate with heated liquid asphalt to form a pre-mixed product, and a satellite plant including a plurality of separate satellite storage bins for receiving the pre-mixed product while still hot, elevator means having an outlet above the top of said satellite storage bins for receiving the pre-mixed product and lifting the same to said outlet, diverter chute means positioned between said elevator outlet and the top of said satellite storage bins for directing the pre-mixed heated product from said elevator outlet directly into the top of any selected one of said bins, weigh hopper means positioned below said satellite storage bins for weighing out a selected amount of said pre-mixed product while still hot from any one of said satellite storage bins, and mixing means positioned below said weigh hopper means for selectively receiving the weighted pre-mixed product from said weigh hopper means and mixing the same with a predetermined amount of heated liquid asphalt, with said mixing means including discharge gate means for emptying the further mixed pre-mix product and asphalt into an underlying truck or the like.

8. The apparatus as defined in claim 5 wherein mixing means of said primary plant and said mixing means for said satellite plant each include means for heating liquid asphalt.

9. The apparatus as defined in claim 7 wherein said primary storage bins and said satellite storage bins are all heat insulated.

10. The apparatus as defined in claim 9 wherein said elevator means at said satellite plant includes an inlet opening adjacent the lower end thereof, and conveyor means for receiving stone aggregate from a delivery truck and conveying the same into said inlet opening.

* * * * *